US007289023B2

(12) United States Patent
Schneider et al.

(10) Patent No.: US 7,289,023 B2
(45) **Date of Patent: *Oct. 30, 2007**

(54) SUPERVISED GUARD TOUR TRACKING SYSTEMS AND METHODS

(75) Inventors: Charles R. Schneider, Alpharetta, GA (US); Wesley C. Adams, Atlanta, GA (US)

(73) Assignee: U.S. Security Associates, Inc., Roswell, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/218,175

(22) Filed: Sep. 1, 2005

(65) Prior Publication Data

US 2006/0090101 A1 Apr. 27, 2006

Related U.S. Application Data

(63) Continuation-in-part of application No. 10/461,249, filed on Jun. 12, 2003.

(60) Provisional application No. 60/388,999, filed on Jun. 12, 2002.

(51) Int. Cl.
*G08B 29/00* (2006.01)

(52) U.S. Cl. ..... 340/506; 340/287; 340/291; 340/293; 340/534

(58) Field of Classification Search ..... None
See application file for complete search history.

(56) References Cited

U.S. PATENT DOCUMENTS 3,781,845 A * 12/1973 Ellul ..... 340/306
3,925,763 A 12/1975 Wadhwani et al.
4,024,527 A 5/1977 Houghton
4,141,006 A 2/1979 Braxton
4,300,124 A * 11/1981 Vasquez ..... 340/306
4,743,892 A 5/1988 Zayle
4,801,786 A 1/1989 Stobbe
4,922,514 A 5/1990 Bergeron et al.
5,120,942 A 6/1992 Holland et al.
5,166,499 A * 11/1992 Holland et al. ..... 235/376
5,398,277 A 3/1995 Martin, Jr. et al.
5,491,672 A * 2/1996 Ferris ..... 368/10
5,572,192 A * 11/1996 Berube ..... 340/574
5,610,596 A * 3/1997 Petitclerc ..... 340/825.23
5,623,258 A * 4/1997 Dorfman ..... 340/10.41
5,696,486 A 12/1997 Poliquin et al.
5,926,100 A * 7/1999 Escolar ..... 340/691.3
6,049,272 A 4/2000 Lee et al.
6,078,255 A 6/2000 Dividock et al.
6,104,294 A * 8/2000 Andersson et al. ..... 340/573.3
6,266,396 B1 7/2001 Johnson
6,295,346 B1 9/2001 Markowitz et al.

(Continued)

*Primary Examiner*—Benjamin C. Lee
*Assistant Examiner*—Son Tang
(74) *Attorney, Agent, or Firm*—Sutherland Asbill & Brennan LLP

(57) ABSTRACT

The present invention comprises systems and methods for addressing exceptions (i.e., alarms) associated with a guard tour according to a predefined hierarchy. The exception is generated automatically based on data associated with the guard tour, as typically collected by an ETTS. The present invention receives tour data, and based upon predefined customer preferences and current conditions, generates a procedure to be followed to optimally resolve the exception. An exemplary exception is one based on the time interval between checkpoints. If, for example, the time interval is outside of a predetermined range, then an exception may be generated.

18 Claims, 7 Drawing Sheets

U.S. PATENT DOCUMENTS 6,353,385 B1 3/2002 Molini et al.
6,369,705 B1 4/2002 Kennedy
6,504,482 B1 * 1/2003 Mori et al. ..... 340/573.1
6,693,530 B1 * 2/2004 Dowens et al. ..... 340/506
6,798,345 B2 * 9/2004 Satoh ..... 340/573.1
6,831,563 B1 * 12/2004 Contractor ..... 340/573.1
2002/0080025 A1 6/2002 Beattie
2002/0163998 A1 11/2002 Mudd et al.
2003/0081735 A1 5/2003 Emory et al.

* cited by examiner

Random Guard Tour Plan - Post #1
ABC Manufacturing Company

Tour Checkpoint Sequence

| Tour Selector Code | Presidents Office | Tool Room | Loading Dock | Reception | Rear Entry | Controllers Office | Side Entry | Parking Lot | Computer Room | Cafeteria |
|---|---|---|---|---|---|---|---|---|---|---|
| A | 1 | 2 | 3 | 4 | 5 | 6 | 7 | 8 | 9 | 10 |
| B | 7 | 4 | 6 | 3 | 1 | 5 | 10 | 8 | 9 | 2 |
| C | 5 | 7 | 6 | 10 | 9 | 8 | 4 | 1 | 3 | 2 |
| D | 3 | 5 | 7 | 6 | 10 | 1 | 4 | 9 | 8 | 2 |
| E | 2 | 3 | 5 | 7 | 6 | 10 | 1 | 4 | 9 | 8 |
| F | 1 | 5 | 6 | 2 | 7 | 3 | 10 | 4 | 8 | 9 |
| G | 9 | 1 | 2 | 3 | 5 | 7 | 6 | 10 | 4 | 8 |
| H | 8 | 9 | 1 | 2 | 3 | 5 | 7 | 6 | 10 | 4 |

FIG. 3

SUPERVISED GUARD TOUR TRACKING SYSTEMS AND METHODS

CROSS-REFERENCE TO RELATED APPLICATIONS

This application is a continuation-in-part of application Ser. No. 10/461,249, filed Jun. 12, 2003, which is incorporated herein by reference in its entirety. This application also claims benefit of U.S. Provisional Application No. 60/388,999, filed Jun. 12, 2002, which is incorporated herein by reference in its entirety.

BACKGROUND OF THE INVENTION

I. Field of the Invention

This invention relates to security systems, and more particularly, to systems and methods of providing centralized monitoring of security guard tours.

II. Background of the Invention

It is well known and quite common for commercial and industrial premises to be protected by security companies providing on-site security guards as a service. A security company typically employs guards, which are assigned to patrol the premises of customers of the security company. To ensure that the premises are protected, each guard is responsible for thoroughly and regularly patrolling all or part of the premises. The security company will specify a "tour" that must be completed by a particular guard at predetermined intervals. A tour consists of a number of checkpoints located along a predefined route. While completing a tour, a guard inspects the customer's property, checking the security of doors and windows, and looking for intruders or other unauthorized activity. In addition, guards take note of situations that may tangentially affect security, including maintenance problems such as lighting fixture failures. To verify completion of each tour, a guard may be required to record the status of the premises at each checkpoint.

The tour record can be created manually, such as by writing entries into a log book, which is subsequently submitted to the security company. However, if a portion of the tour was not completed, or a non-emergency situation was logged, the security company would not be notified in a timely manner. For instance, if a theft went undetected during a guard's shift, the security company would have to review the log to determine whether the guard failed to detect the theft because one or more checkpoints were omitted from that guard's tour. Electronic tour tracking systems address this problem by automating the process of logging the tour. An electronic tour tracking system (ETTS) includes a means for electronically recording checkpoint conditions, and a means for uploading the information to a centralized monitoring center (CMC). The CMC may be located on or off the customer premises. With an exemplary ETTS, a guard touches a wand to a button fixed at each checkpoint, thereby creating an electronic record of the date and time that the checkpoint was toured. The record is stored in the wand until the guard uses a docking station to upload the data to the CMC. At a minimum, uploads preferably occur at the end of each tour.

If the guard encounters any condition or event that should be brought to the attention of the security company and/or customer, the guard may be able to enter additional information into the wand. The additional information is entered using a keypad, or a portable set of buttons to which the guard can touch the wand. Each of the portable set of buttons corresponds to a different condition or event, such as "broken lock" or "theft detected." When the wand is uploaded, an exception is generated, which may appear as an icon alarm or other alert mechanism at the CMC.

An exception indicates to a CMC operator that a condition exists that must be rectified, for instance, by dispatching maintenance or security personnel by notifying emergency agencies or utility companies, or by notifying the customer. The condition is best rectified by selecting the most cost-effective and least disruptive option for determining the cause of the exception, and for notifying the appropriate responder. In other words, if the exception can be cleared by contacting the guard on duty to verify that a problem actually exists, the customer will appreciate that the problem is resolved without the customer's intervention. However, the exception may require the customer or operator at the CMC to personally reset an alarm. CMC operators typically simultaneously monitor more than one customer site in more than one geographic location—potentially all of the customers served by the security company. It is therefore difficult for operators to quickly determine the optimum protocol for addressing each exception that occurs, and to access the telephone numbers, work schedules, and names of guards, customers, local law enforcement, and supervisory staff that should respond to the exception. It is also possible for an exception to go unresolved, remaining in a pending state indefinitely if the operator fails to notice the alert.

Thus, although an ETTS can improve communication of conditions reported by the guard to the CMC and to the customer, the responsiveness and service quality of the security company can be impaired if the CMC personnel cannot properly respond to exceptions generated by the ETTS.

Therefore, there is an unresolved need for an ETTS that ensures that an exception is addressed by contacting the most appropriate responder for the situation.

SUMMARY OF THE INVENTION

The present invention addresses the needs identified above by providing systems and methods for addressing exceptions according to a predefined hierarchy, and for ensuring that each exception is resolved in a timely manner.

An embodiment of the present invention interfaces with an ETTS to control the resolution of exceptional conditions or events at customer premises by utilizing tour data from any number of customer premises in conjunction with security company, customer, utility company, and emergency agency data. The present invention receives tour data, and based upon predefined customer preferences and current conditions, generates a procedure to be followed to optimally resolve the exception.

One aspect of the present invention is the ability to customize an exception handling procedure according to various parameters, including customer, exception type, day, date, and time of day. In response to an exception, a contact list is generated, the contact list being associated with one or more of the parameters. The alarm created by the exception will not be closed out until the exception is resolved and an appropriate reason code for the exception is entered into the system.

Another aspect of the present invention is the ability to resolve the exception in the least costly and disruptive manner. Access to contacts on the contact list is controlled according to a predefined response hierarchy, preferably defined by the customer.

Another aspect of the invention is the ability to escalate the resolution to increasing higher levels of responders according to the severity of the exception or to the response or lack of response of the responder(s) previously contacted.

Yet another aspect of the present invention is the ability to generate reports that enable security companies and customers to improve infrastructure and response to exceptions.

In accordance with an embodiment of the present invention, a method for processing and resolving exception alarms associated with a guard tour at a premise comprises collecting tour data associated with a guard tour at a premise, analyzing the tour data to determine if an indication of an exception associated with the guard tour, and if an exception is identified in the analysis of the tour data, then generating an exception alarm, generating an exception handling procedure based on the exception and at least one other criteria, and receiving a reason code inputted by a user and based on the reason code closing the exception alarm or escalating the exception alarm. The other criteria utilized in generating the exception handling procedure may be selected from a group comprising the time, location, day of week, date, customer preference, and other identified exceptions. The exception handling procedure may comprise a list of people to contact in a specified order, and the step of collecting the tour data may comprise retrieving the tour data from a remote computer. The method may further comprise classifying the exception and storing the classification in a manner so that the classification is related to the exception, and/or generating at least one report based on a plurality of exceptions identified. The tour may include a tour plan that is randomly selected from a plurality of possible tour plans for the premise, and the step of analyzing the tour data may include determining if the tour data comprises one or more of missing checkpoints, improperly sequenced checkpoints, improper timing parameters for completion of the tour or individual checkpoints, and maintenance exceptions. Also, escalating the exception alarm may comprise contacting a next responder listed in the exception handling procedure.

In accordance with another embodiment of the present invention, a computer system for processing and resolving exception alarms associated with a guard tour at a premise comprises a collection module that periodically retrieves tour data associated with a tour at a premise, a comparison module that analyzes the tour data to determine if an indication of an exception associated with the guard tour, and an exception processing module that performs the following steps if an exception is identified in the analysis of the tour data: generating an exception alarm, generating an exception handling procedure based on the exception and at least one other criteria, and receiving a reason code inputted by a user and based on the reason code closing the exception alarm or escalating the exception alarm. The computer system further comprises an exception reporting module that generates reports based at least in part on the exception. The other criteria may be selected from a group comprising the time, location, day of week, date, customer preference, and other identified exceptions, and the exception handling procedure may comprise a list of people to contact in a specified order. Escalating the exception alarm may comprise contacting a next responder listed in the exception handling procedure, and the step of analyzing the tour data may include determining if the tour data comprises one or more of missing checkpoints, improperly sequenced checkpoints, improper timing parameters for completion of the tour or individual checkpoints, and maintenance exceptions.

In accordance with yet another embodiment of the present invention, a computer-readable medium having computer-executable instructions for performing a method for processing and resolving exception alarms associated with a guard tour at a premise comprises collecting tour data associated with a guard tour at a premise, analyzing the tour data to determine if an indication of an exception associated with the guard tour, and if an exception is identified in the analysis of the tour data, then generating an exception alarm, generating an exception handling procedure based on the exception and at least one other criteria, and receiving a reason code inputted by a user and based on the reason code closing the exception alarm or escalating the exception alarm.

An aspect of the present invention is the evaluation of the time interval between checkpoints on a tour. Intervals that exceed a predetermined range may result in an exception. The predetermined range can be user defined or based on a percentage variance or other criteria as desired. The predetermined intervals and range(s) can be empirically determined.

Additional objects, advantages and novel features of the present invention will be set forth in part in the description which follows, and in part will become more apparent to those skilled in the art upon examination of the following, or may be learned by practice of the invention.

BRIEF DESCRIPTION OF THE DRAWINGS

Figure 1:
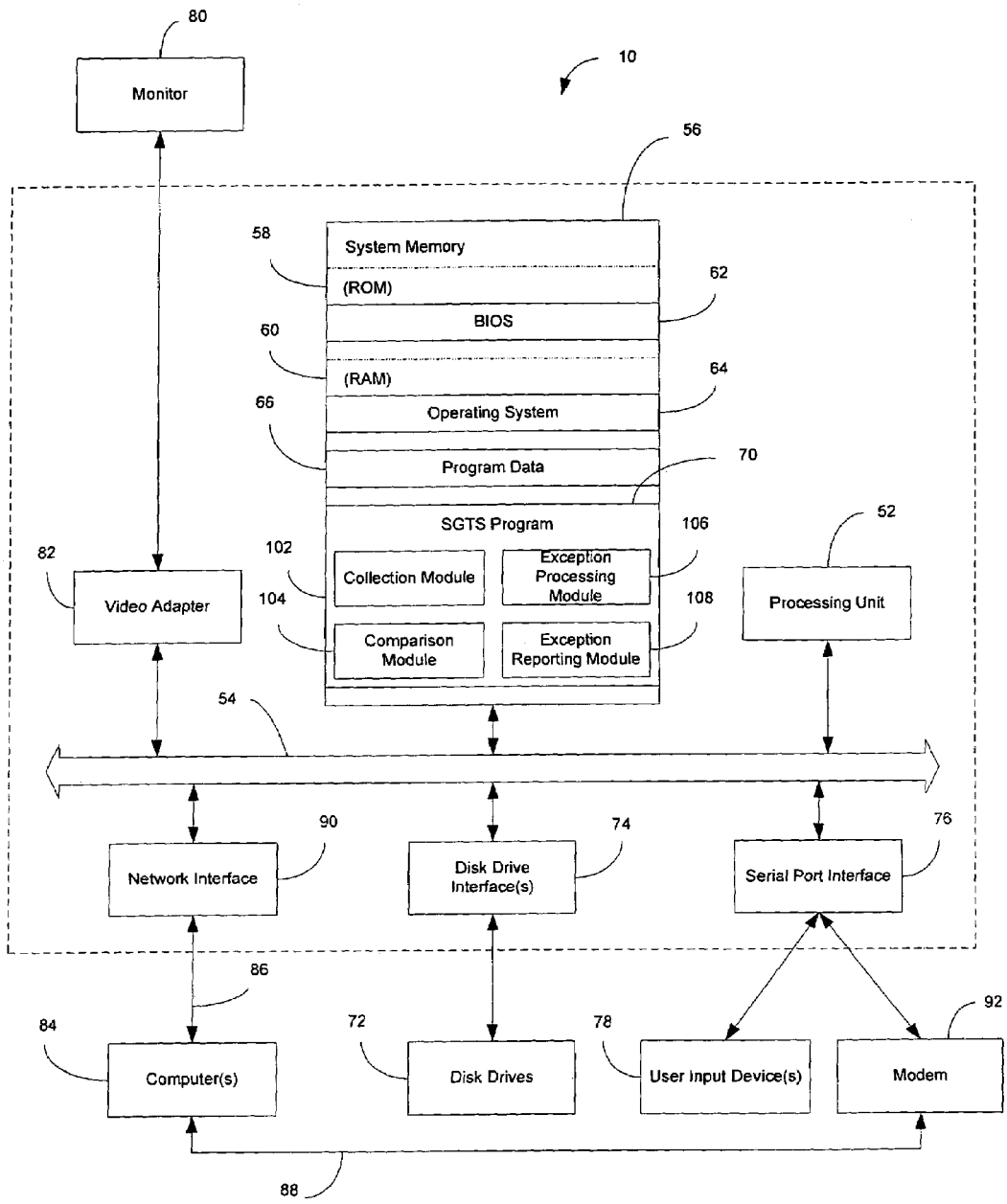

Having thus described the invention in general terms, reference will now be made to the accompanying drawings, which are not necessarily drawn to scale, and wherein:

FIG. 1 shows an exemplary computing environment, according to an embodiment of the present invention.

Figure 2:
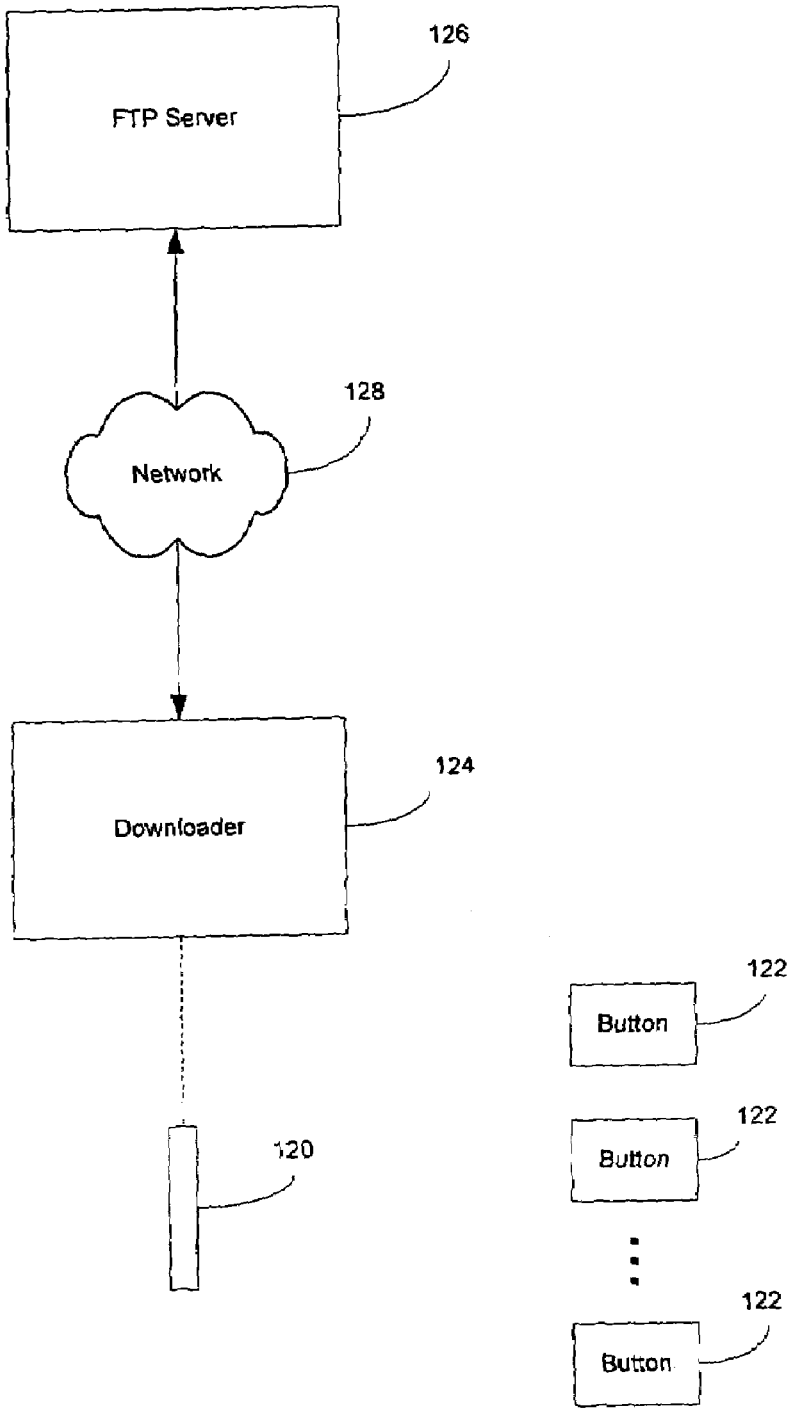

FIG. 2 shows an exemplary ETTS, according to an embodiment of the present invention.

FIG. 3 shows an exemplary random guard tour plan, according to an embodiment of the present invention.

Figure 4:
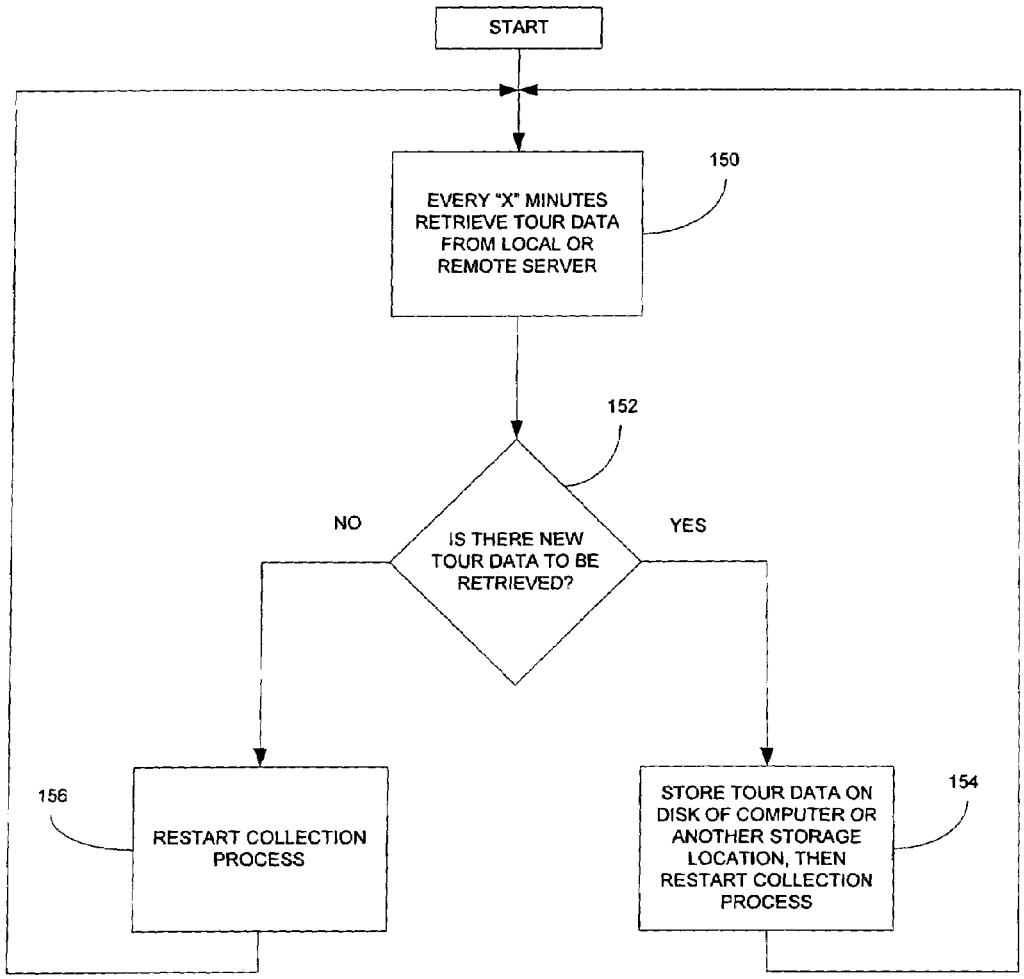

FIG. 4 shows an exemplary flowchart of the operation of the collection module, according to an embodiment of the present invention.

Figure 5:
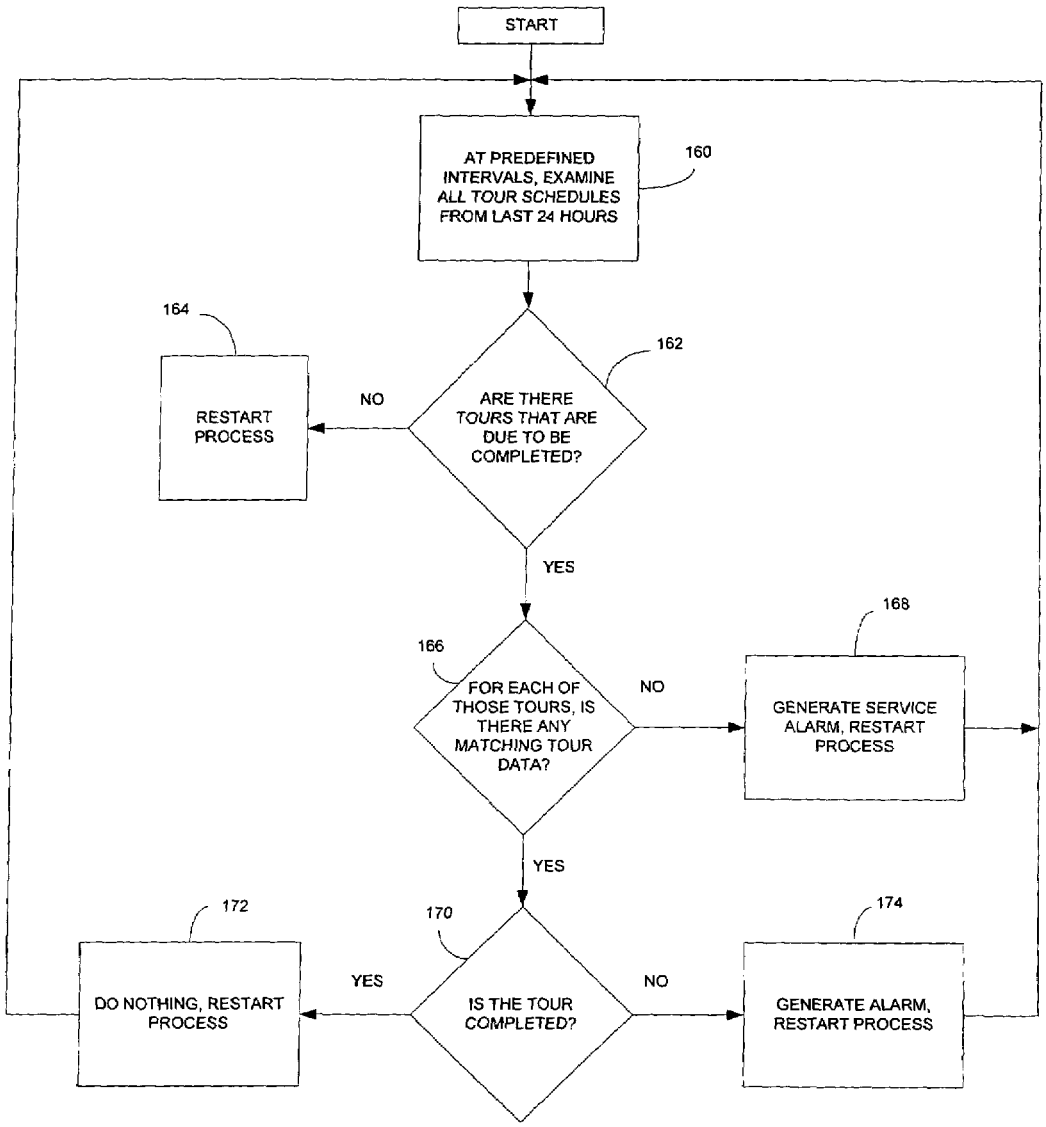
Figure 6:
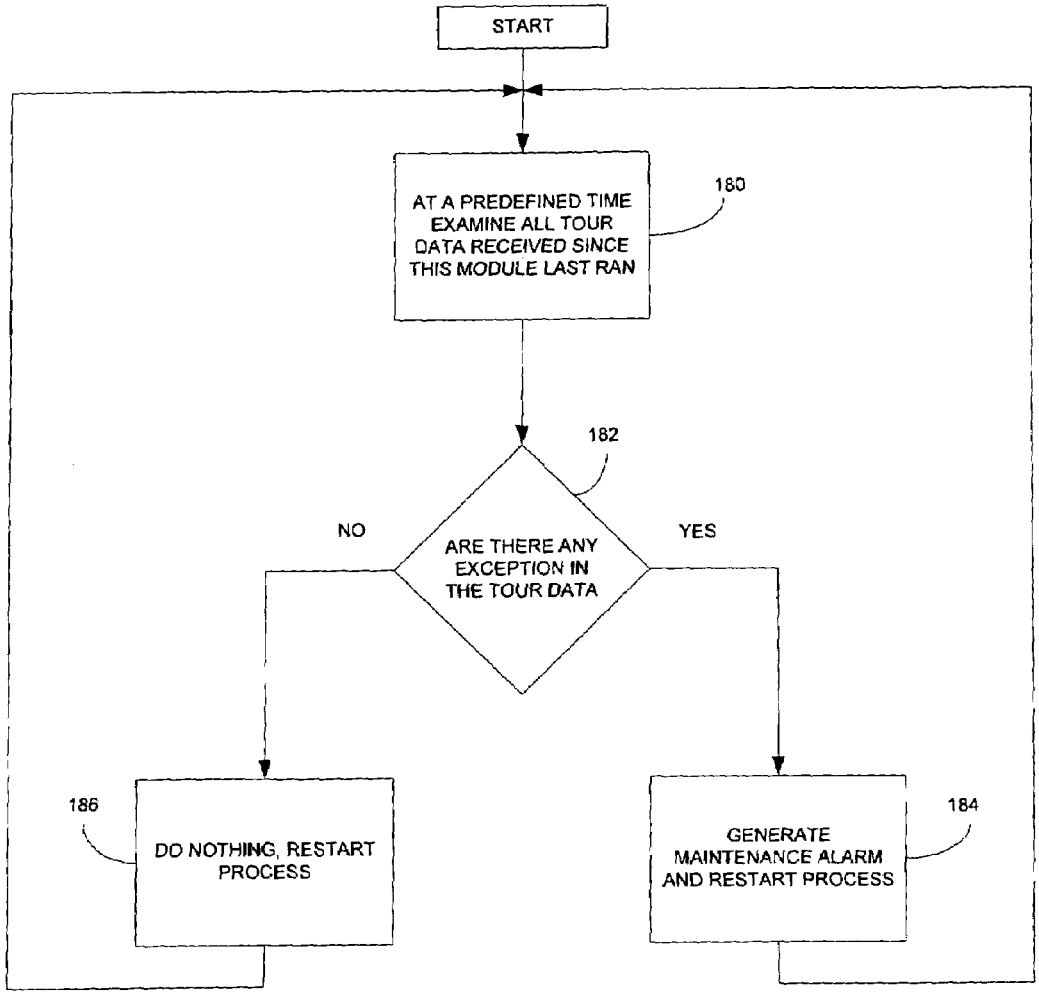

FIGS. 5-6 show exemplary flowcharts of the operation of the comparison module, according to an embodiment of the present invention.

Figure 7:
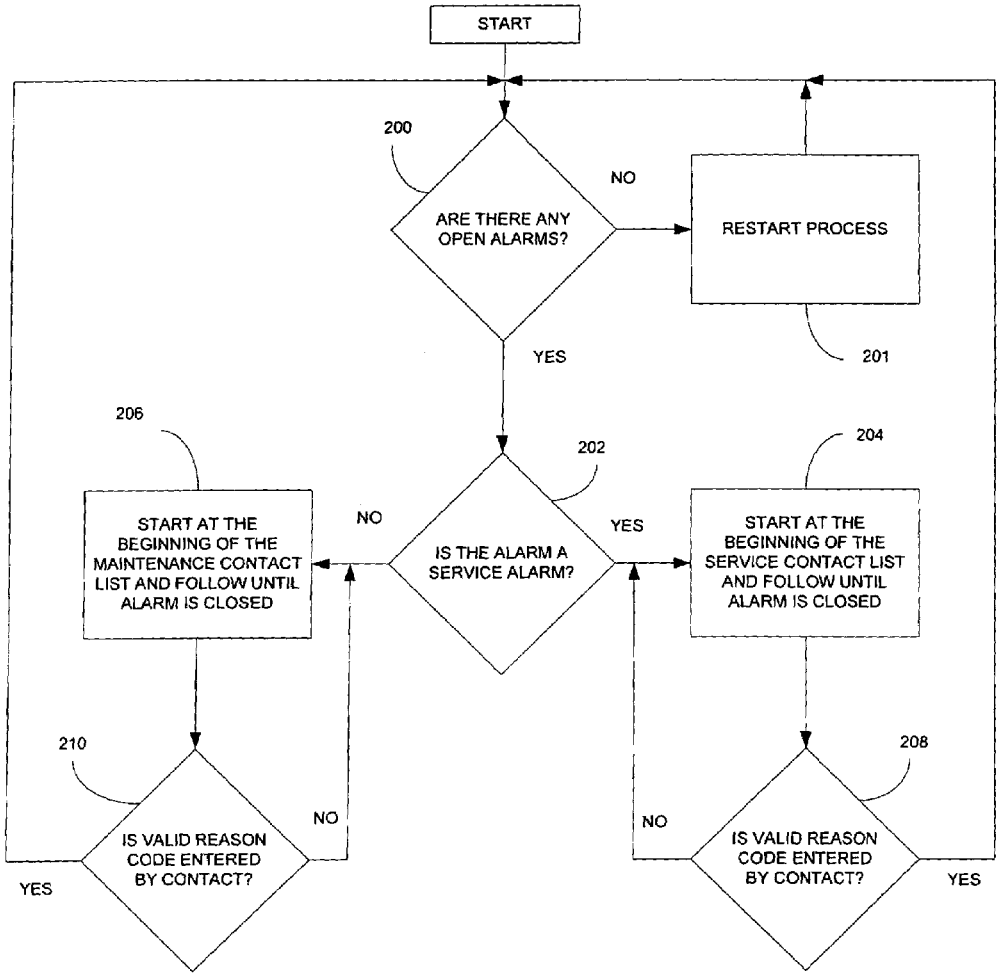

FIG. 7 shows an exemplary flowchart of the operation of the exception processing module, according to an embodiment of the present invention.

DETAILED DESCRIPTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is described below with reference to block diagrams and flowchart illustrations of systems, methods, apparatuses and computer program products according to an embodiment of the invention. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions. The present invention comprises systems and methods for accurately and robustly predicting flame blowout precursors for combustors. The present invention is applicable to all types of combustors and is designed to operate over a diverse range of environmental condition, including varying temperatures, humidity, air compositions, and fuel compositions.

Exemplary embodiments of the present invention will hereinafter be described with reference to the figures, in which like numerals indicate like elements throughout the several drawings. FIG. 1 illustrates an exemplary environment 10 for implementing the present inventions in or through use of computers. For example, the inventions may be implemented through an application program running on an operating system of a computer. The inventions also may be practiced with other computer system configurations, including hand-held devices, multiprocessor systems, microprocessor based or programmable consumer electronics, mini-computers, mainframe computers, etc.

Application programs that are components of the invention may include routines, programs, components, data structures, etc. that implement certain abstract data types, perform certain tasks, actions, or tasks. In a distributed computing environment, the application program (in whole or in part) may be located in local memory, or in other storage. In addition, or in the alternative, the application program (in whole or in part) may be located in remote memory or in storage to allow for the practice of the inventions where tasks are performed by remote processing devices linked through a communications network.

FIG. 1 illustrates a computer 50 which may be utilized at a centralized monitoring center (CMC) in accordance with the present invention. The computer 50 includes a processor (also referred to as a processing means or processing unit) 52 joined by a system bus 54 to a memory 56 (also referred to as system memory). The memory 56 may include read only memory (ROM) 58 and random access memory (RAM) 60. The ROM 58 stores the basic input/output system (BIOS) 62, which contains basic routines that aid in transferring information between elements within the computer 50 during start-up, and at other times. The RAM 60 may store program modules and drives. In particular, the RAM 60 may include an operating system 64, program data 66, a web browser program (not illustrated), and one or more application programs such as an embodiment of the present invention, referred to herein as the Supervised Guard Tour System (SGTS) program 70.

The computer 50 also may include a plurality of drives interconnected to other elements of the computer 50 through the system bus 54 (or otherwise). Exemplary drives 72 include a hard disk drive, a magnetic disk drive, and an optical disk drive. Specifically, each disk drive may be connected to the system bus 54 through an appropriate interface 74. Further, the computer 50 may include non-volatile storage or memory through the drives and their associated computer-readable media. For example, the magnetic disk drive allows for the use of a magnetic disk; and the optical disk drive allows for the use of an optical disk. Other types of media that are readable by a computer, e.g., magnetic cassettes, digital video disks, flash memory cards, ZIP cartridges, JAZZ cartridges, etc., also may be used in the exemplary operating environment.

In addition, the computer 50 may include a serial port interface 76 connected to the system bus 54. The serial port interface 76 connects to input devices 78 that allow commands and information to be entered. These input devices may include a keyboard, a mouse, and/or other input device. Pens, touch-operated devices, microphones, joysticks, game pads, satellite dishes, scanners, etc. also may be used to enter commands and/or information. The input devices also may be connected by other interfaces, such as a game port or a universal serial bus (USB). Further, the computer 50 may include a monitor or other display screen 80. The monitor 80 is connected through an interface such as a video adaptor 82 to the system bus 54. The computer 50 may include other peripheral and/or output devices, such as speakers or printers (not illustrated).

The computer 50 may be connected to one or more remote computers 84, and may operate in a network environment. The remote computer 84 may be a computer, a server, a router, a peer device or other common network node, and may include many or all of the elements described in relation to the computer 50. The connection between the computer 50 and the remote computer 84 may be through a local area network (LAN) 86 and/or a wide area network (WAN) 88. The computer 50 is connected to the LAN 86 through a network interface 90. With respect to the WAN 88, the computer 50 may include a modem 92 or other device to channel communications over the WAN 88, or global data communications network (e.g., the Internet). The modem 92 (internal or external) is connected to the system bus 54 via the serial port interface 76. The network connections illustrated in FIG. 1 are exemplary and other ways of establishing a communications link between the computer 50 and a remote computer 84 may be used.

In accordance with an illustrative embodiment of the present invention, the SGTS program 70 includes a collection module 102, a comparison module 104, an exception processing module 106 and an exception reporting module 108. In operation, the centralized monitoring performed by the SGTS program 70 is executed in several phases. First, tour data is gathered using an ETTS, which is at least partially managed by the collection module 102. As described above, a guard completes a tour by collecting data at each checkpoint, and then the data is uploaded to the CMC. Next, the uploaded data is compared to tour schedules that have been established according to the customer's requirements, which is at least partially implemented by the comparison module 104. Customer requirements may vary based upon the level of service purchased by the customer from the security company, and the date, day, time, and conditions at the premises. If the comparison reveals that an exception has occurred, then an alarm is generated, and an exception handling procedure is invoked, which is at least partially implemented by the exception processing module. Finally, tour and exception data is reported for tracking and analysis by the customer and the security company, which is at least partially implemented by the exception reporting module 108. The operation and functionality of each module in accordance with an embodiment of the present invention is described in more detail below.

Collection Module

The data collection begins with a guard at a customer premise using an ETTS, for example, one of the systems available from Deggy Corporation of Miami, Fla. A schematic illustration of an exemplary system is provided in FIG. 2, and includes a wand, PDA, or other portable data terminal 120 that reads that serial numbers stored inside buttons 122 located throughout the customer premise. Each button 122 is coded with a unique serial number that can be read by the wand 120. When the guard touches the wand 120 to a button 122, the wand 120 beeps and stores the serial number of the button 122 along with the current time and date. When the guard uses the wand 120 to record the serial numbers of buttons 122 in a certain sequence, it is commonly referred to as a tour, and the data gathered is called tour data. The tour data is stored in the wand 120 until the guard plugs the wand into a cradle or downloader 124 for uploading to a computer. For example, the Deggy web downloader may be utilized to deliver the tour data from the customer premise to a secure FTP server 126 via a communications network 128, which can be any private or public, wireless or landline (or combinations thereof) network suitable for transmitting data securely. When the user plugs the wand 120 into the downloader 124, the downloader retrieves the data from the wand 120 and clears the wand's memory. The downloader 124 then dials an FTP server 126 using a phone line connected to the downloader 124 and then uploads the tour data to the FTP server 126. The downloader 124 then clears its own memory.

In accordance with an aspect of the present invention, the tour plan may be random, as opposed to a set tour. That is, the specific sequence of checkpoints the guard is to pass may change according to which tour is selected. For example, a client site may have a plurality of tour sequences identified by tour codes, and when a guard checks in at a post or at some point prior to the time the tour should be conducted, one of the plurality of tour codes is randomly selected and communicated to the guard, such as by an automated call to the guard using voice simulation software or by e-mail. The selected tour is known by the computer 50 for implementation of the present invention. A table illustrating exemplary tour checkpoint sequences identified by a tour selection code is provided by FIG. 3. As shown, tour codes A-H may be randomly selected to increase the security provided.

At the CMC, the collection module 102 of the computer 50 downloads the tour data from the FTP server at regularly scheduled intervals. In an exemplary embodiment, as illustrated in FIG. 4, the collection module 102 collects and stores tour data every 15 minutes, as indicated by block 150. Preferably, the collection module 102 runs constantly, gathering data and storing the data on one or more of the disk drives 72, wherein the frequency may be set to anything greater than the amount of time it takes the module to complete one cycle. The collection module 102 may utilize a connectionless protocol to download the raw tour data from the FTP server 126. It should be noted that there exist numerous other means for retrieving data from the wand 120, such as by a wireless connection directly to the wand 120 or by electronic mail. If there is any new data to be collected at the FTP server, as determined at block 152, then the collection module 102 retrieves the tour data and stores it on a disk drive 72, such as by appending the data to a master tour file, preferably resident at the computer 50, as indicated by block 154. The collection module 102 then waits another cycle before it seeks to retrieve new data from the FTP server again. If there is no new tour data to collect, then the process is complete and the collection module 102 waits for another cycle before it tries again, as indicated by block 156.

Comparison Module

In the exemplary embodiment, as illustrated in FIG. 5, the comparison module runs on a periodic basis, such as every hour on the hour, as indicated by block 160. The comparison module accesses a client-based tour requirements file, which contains data indicating when a tour should be completed. The tour requirements file also includes a client identifier, client contact data for each tour, tour frequency, and other tour-related information. As discussed about the tour plan may be randomly chosen so the tour requirements physical file will have to be updated regularly with the tour code chosen for each tour.

The comparison module then determines if a tour should have been completed since the last cycle of the module, as indicated by block 162. Based on the current time and the expected tour schedule, the comparison module decides that there should be at least some tour data stored to match the schedule. If no tours should have been completed since the last program cycle, then the process is restarted, that is, it is executed again at the time of the next program cycle, as indicated by block 164. For each tour that should have some tour data stored by this time of the day, the data from the tour requirements file is compared to the master tour file to determine if there is match of a tour in the tour requirements file with tour data in the master tour file, as indicated by block 166. If the comparison module does not find a tour in the master tour file that corresponds to a tour in the tour requirements file and is within a predefined period of time of when the tour should have been completed, then an alarm is generated.

If there is no tour data, an alarm is generated and stored in an alarm file on the computer disk drive, as indicated by block 168. The alarm file will contain information like, to which client the alarm belongs, when the tour should have been completed, and is it a service alarm or a maintenance alarm. In this example it is a service alarm because no tour was completed. Any variation in the tour schedule, outside a predefined tolerance, results in generation of an a service alarm.

If there is some tour data stored that matches the schedule, it is determined at block 170 if the tour data is complete. If the tour data is complete, then nothing is done but wait for the next cycle of this module, as indicated by block 172. If the tour data is incomplete, then a service alarm is generated and the module begins waiting for the next cycle, as indicated by block 174. It is worth noting that the process of checking whether or not there is tour data on file is done for at least each scheduled tour that should have tour data this cycle.

With reference now to FIG. 6, the comparison module next examines the tour data collected since the last time this module ran, as indicated by block 180. At block 182, it is determined if there are any exceptions in the tour data. If there is any maintenance exception data then the system creates an alarm, as indicated in block 184. Maintenance exception data includes items such as unlocked doors or broken windows. Such exceptions are generated, in the illustrative embodiment, by the guard using a "wallet" that contains various special purpose buttons. If the guard is making a tour and reading the serial numbers off buttons, and in doing so notices an open door or a broken window, the guard can "read" one of the special buttons and indicate the problem. If the comparison module finds one of the exception buttons in the tour data, a maintenance alarm is created and then the system waits until the next cycle for this module to restart. If there is no exception button data, then the system waits until the next cycle of this program to restart, as indicated by block 186.

It should be noted that while the illustrative embodiment distinguishes between service alarms and maintenance alarms, this is not required for purposes of implementing the present invention. To the extent the alarms are classified, they need not be limited to service or maintenance, and may include additional or completely different classifications. An advantage to distinguishing the type of alarm is the ability to analyze and repot incidents based on the type of alarm, which may be useful in certain applications.

Exception Processing Module

In the illustrative embodiment, the CMC is continuously staffed 24 hours each day. Preferably, an operator monitors one or more display devices, which may be associated with one or more client sites or regions. The operator is preferably human, although a software application can be utilized instead to implement the functionality described herein. When an exception (i.e., alarm) is generated, an alert occurs. An alert may comprise an audible or visual alarm, such as a red alarm icon on the display device, which may blink or flash, and which may be accompanied by a beep or tone. The exception is then considered to be "open." Once an exception is opened, the invention requires the operator to follow a procedure to close the exception.

A benefit of the present invention is that the exception handling procedure may be customized for each customer, each tour, each checkpoint, and each exception type. The exception handling procedure may also vary based upon the day of the week, time of day, weather conditions, or other parameter. Each exception handling procedure also includes a hierarchy of responders that are to be notified to clear the exception.

The security company can establish a set of default exception handling procedures. For example, the default exception handling procedure for a broken window exception can dictate that the responsible guard is the appropriate responder at the first level of the response hierarchy, followed by a maintenance supervisor at the next level of the response hierarchy. For each customer, the security company maintains a database of contact names, duty schedules, titles, and contact information. For each type of exception, which is preferably identifiable by a code, a contact list is generated that contains contact information for the appropriate responders for that exception code, in view of the customer requirements and other decision parameters (time of day, etc.). When the broken window exception occurs, the names and contact data for the responsible guard and the maintenance supervisor are retrieved from the database and presented to the operator for initiating the resolution of the exception.

The customer can elect to implement a variation of a default exception handling procedure, such as by adding a level to or removing a level from the hierarchy, or by conditioning one or more steps of the procedure on the occurrence of an event. The customer can choose to use the same exception handling procedure for multiple exception types. The customer requirements may call for a different exception handling procedure for the same exception code according to conditions on the customer premises. For instance, if the same exception code is received twice within a predefined period of time, the exception handling procedure may immediately escalate by skipping lower levels in the contact hierarchy. This feature is particularly useful in detecting trends in the observations of different guards on different tours of the same facility. If multiple "broken lock" exceptions are recorded by guards within one hour of each other, for example, the CMC operator effectively cross-references the tours, and provides a heightened response to an apparent intruder.

In the exemplary embodiment, as illustrated in FIG. 7, the exception processing module initially looks for any open exception, as indicated by block 200. An open exception is an alarm that has not had a valid reason entered into the system for why the alarm was created and/or that appropriate measures have been taken. For example, one valid reason why the exception alarm was created is that the tour was not performed by the guard. The program starts by reading the alarm file that is stored in the computer system 50. If there are no open exceptions, the module restarts, as indicated by block 201. However, if there are open exceptions, then the exception processing module generates a contact list that is specific to that client site for that exception. Specifically, it is determined at block 202 if the exception alarm is a service alarm or not. If so, then the service contact list is generated and presented to the operators so that each person on the list can be contacted, in order, until a valid reason can be entered for why the alarm was created, as indicated by block 204. If the alarm is a maintenance alarm, the maintenance contact list is generated and presented to the operator so that each person on the list can be contacted, in order, until a valid reason can be entered, as indicated by block 206.

The calls are made by real people, preferably the operators at the CMC. The operators sit in front of a computer screen managing the exception processing. When an exception alarm is generated, a message pops up on the operator's screen that explains why the alarm was created, along with a list of the people that need to be called. The operator starts with the lowest ranking person on the list and calls each person, progressing up through the hierarchy, until a valid reason can be retrieved from the contact and entered into the alarm file. The users continue to call the responders until each alarm is closed with a valid reason code entered, as indicated by blocks 208 and 210.

The following is a non-inclusive set of examples of exception handling procedures according to the present invention:

EXAMPLE 1

On a Saturday afternoon, a "missed tour" exception is generated. A CMC operator promptly responds to an associated exception alert that appears on the operator's data terminal. By clicking on the alert icon, an exception window opens. The exception window contains a field that contains data from the master tour file, such as the client identifier, checkpoint identifier, an exception code and associated text indicates that the tour has been a missed, time and date that the exception occurred, and the name and contact information for the guard who should have completed the tour. If the customer premise is closed for the weekend and contains valuable and easily portable equipment, then the system generates an exception handling procedure that requires immediate notification of all guards on duty at the premise. Contact information for the guards is displayed, and the CMC operator notifies the guards of the situation. If the guard responsible for the tour responds, the CMC operator will determine whether the tour was completed, but not properly uploaded, or actually missed. If the tour was completed, the CMC operator inputs a reason code into a computer 50 that indicates the cause of the upload failure (e.g., guard error, equipment failure, or software failure), thereby closing the exception.

If the responsible guard is not reached, the CMC operator will request another guard to check the status of the responsible guard. If the operator determines that the tour was in fact missed without good cause, the "unexcused missed tour" reason code is inputted, and system provides the name and contact information of that guard's supervisor(s).

If no guards can be reached, the CMC operator enters the corresponding reason code, thereby causing the exception handling procedure to "escalate." The exception handling procedure goes to the next level in the contact hierarchy. A new or updated exception window displays the next level of respondents to be notified—in this instance, the police.

EXAMPLE 2

On a weekday, a "broken lock" exception is generated at a busy office building. A CMC operator promptly responds to the alert by clicking on the alert icon, and an exception window opens. The exception window indicates that a lock on a door to the parking garage is broken, permitting access to unauthorized personnel. The exception handling procedure indicates that the CMC operator is to contact the responsible guard to verify the condition. If the condition is verified, the CMC operator enters the reason code into computer 50 that confirms the condition, thereby escalating the exception handling procedure, and receives contact information for the appropriate maintenance staff (either employees of the customer or outside contractors). The unlocked door creates a potentially dangerous situation for employees parking in the garage. Therefore, the "broken lock" exception code associated with that particular checkpoint also causes the exception handling procedure to prevent the CMC operator from closing the exception until the appropriate security company supervisor has also been notified of the situation. The security company supervisor will adjust tour schedules or dispatch additional guards to investigate and monitor the door until the lock is repaired.

If no guards can be reached, the CMC operator escalates the exception handling procedure by entering the appropriate reason code. The exception handling procedure goes to the next level in the contact hierarchy. A new or updated exception window displays the next level of respondents to be notified. In this example, the exception handling procedure may escalate through several levels of security company staff before notifying the police, to avoid unnecessarily disrupting the customer's operations while the situation is being resolved. Upon notifying the police, the CMC operator enters a reason code that indicates that police have been notified, but that the situation has not been resolved. The exception will remain pending until reason codes are entered that indicated that the police have found that the facility is safe, and the maintenance staff has repaired the lock.

EXAMPLE 3

A "water leak" exception is generated when a guard notices that condensate is draining from an air conditioner near a checkpoint. After upload, the CMC operator clicks the alert icon, and the exception window displays the customer's maintenance supervisor's name and contact information. The CMC operator contacts the supervisor, and informs the supervisor of the leak. The maintenance supervisor indicates that the problem will be addressed. The CMC operator enters a reason code that indicates that the customer intends to address the situation. However, this customer has required an exception handling procedure that, in response to this reason code, places the exception in a pending state, rather than allowing the CMC operator to close the exception. The exception remains in a pending state, periodically sounding or displaying a new alert, until the maintenance supervisor communicates completion of the repair to the CMC operator. The CMC operator changes the reason code to "customer has resolved," thereby closing the exception.

In any instance, a CMC operator has the option to close the exception by entering a reason code that permits closing the exception, or to escalate the exception by entering a reason code that requires the operator to contact the next level of responders in the hierarchy. All exception codes and reason codes can be provided using any suitable data management tool, such as drop-down or pull-down fields, decision trees, or searchable field, etc.

An advantage of the present invention is the automated manner in which exception codes and alarms are generated, and the manual manner in which the operator enters reason codes to close or escalate the exception processing. This human interaction is often key to accurate, consistent and reliable resolution of exceptions.

At each level of the response hierarchy, the exception window may display a list of personnel that can be contacted. The CMC operator may contact any one of the personnel or agencies displayed in a given list, or may be required to contact the personnel in order, indicating whether each was successfully contacted. Responders can be contacted manually by the CMC operator, or an autodial or voice response feature can be implemented.

Exception Reporting Module

At least once daily, preferably, the exception reporting module calls at least one report program generator (RPG), which generates reports used by the customer and the security company to analyze the data collected and stored in the master tour file. For instance, the RPG can compile a report that show the frequency of specific types of exceptions. The security company can use this exception frequency report to determine whether a particular element of the ETTS, such as the docking station or a particular wand, should be replaced due to frequent failures. The RPG can also compile reports that identify problem personnel, by determining which guards frequently fail to correctly complete tours. The data gathered and stored in the master tour file can potentially be used for any number of purposes, including, but not limited to identification of training needs, and provision of information to insurance companies.

The foregoing description of the preferred embodiments of the invention has been presented only for the purpose of illustration and description and is not intended to be exhaustive or to limit the invention to the precise forms disclosed. Many modifications and variations are possible in light of the above teaching. For example, all of the foregoing examples can be implemented with any suitable processing equipment and environment, and any combination of communications and device interface technologies. The exception handling procedures, responder types, exception types, information provided, and ETTS processes in the examples are not exhaustively enumerated. Rather, this invention is applicable to improving exception response procedures in any type of security system, which communicates over any suitable communications medium using any suitable communications protocol, and which provides information to a centralized control center or to distributed responders to optimize or customize the handling of various types of exception situations.

Checkpoint Interval Tracking

The comparison module can be configured to evaluate the time intervals between checkpoints on a tour to determine if the time it takes a guard to travel from one checkpoint to another is too short or too long, and in either case generate an exception as appropriate. The comparison module can determine the time interval between two checkpoints using timestamp data associated with each checkpoint. In accordance with the present invention, the time intervals can be the elapsed time between two consecutive checkpoints or the elapsed time between two nonconsecutive checkpoints. A time interval is compared to one or more predetermined values to determine if an exception occurred. The predetermined values can be empirically determined, and if desired, regularly updated based on use and/or other factors. In a preferred embodiment, the time interval is compared to a predetermined range. If the time interval is less than the minimum value of the range or more than the maximum value of the range then an exception is generated. Alternatively, an exception can be generated by comparing the time interval to only the minimum value or only the maximum value.

The result of the comparison may be utilized as a determining factor in generating an alarm or as one of several factors or criteria considered in the generation of an alarm. For example, the occurrence of another exception during the tour might negate the time interval exception because the reason for the other exception might be considered to have caused the time interval exception. In addition, the other data collected during that tour or another tour can be utilized to modify the predetermined maximum and minimum values. For example, rather than negating a time interval exception, as discussed above, the other exception may result in the increasing or decreasing of the predetermined time interval values. As another example, a single occurrence of a time interval being outside a predetermined may not result in an alarm, a certain number of occurrences, perhaps within a certain timeframe, may result in a alarm indicating the reason that the time interval is repeatedly outside the range should be investigated. It may even result in the modification of the predetermined time range, so as to include longer and/or shorter intervals of time.

A time interval less than the predetermined minimum time may indicate, for example, that the checkpoints have been moved, that is, the guard may have moved one or more of the buttons 122 from their respective locations throughout a facility to another location, presumably in an effort to reduce the length of the tour. This is undesirable because the relocation of the checkpoints jeopardizes the safety and security of the facility. Since some guards are generally unsupervised for a large portion of their shift, this additional degree of supervision is beneficial.

A time interval greater than the predetermined maximum time may indicate, for example, that the guard conducting the tour dealt with an issue during the tour, though presumably not one the guard was able to record as an exception with the wand 120. If such occurs on a regular basis, such as more than a predetermined times within a defined period of time as can determined by the comparison module, then an exception may be warranted and/or the cause of the delay investigated by the CMC. As an example, if the guard periodically finds and investigates a noxious odor at a particular location of the tour, then the guard may exceed the predetermined maximum time between checkpoints. If the wand 120 does not allow the guard to record an exception for noxious odors, then the problem may persist. Alternatively, when the time interval data is consistently outside the predetermined range, then that may generate a separate exception suggesting the predetermined values should be changed or at least reviewed.

In accordance with the random tour plan discussed above, the predetermined values or ranges can be designated by the particular tour plan or by the sequence of the checkpoints. Thus, once the tour plan or checkpoint sequence is known, then a time interval or range between any two checkpoints on the tour can be determined and utilized in accordance with the present invention.

In accordance with an embodiment of the present invention, there can be more than one predetermined range. For example, wherein a time interval that is outside of one range but within another might generate a different alarm than a time interval outside of both ranges. The different ranges may be considered in combination with other data collected during a tour, such as other exceptions or recorded conditions, in the generation of an alarm.

Accordingly, many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for processing and resolving exception alarms associated with a guard tour at a premise, comprising:

collecting tour data from a guard device associated with a guard tour at a premise, wherein the tour comprises a plurality of checkpoints;

identifying an exception by analyzing the tour data to identify an elapsed time interval between two checkpoints during the guard tour that is outside a predetermined range; and if an exception is identified in the analysis of the tour data, then generating an exception alarm remote from the guard device, the exception alarm subjectable to selective closing and escalating, generating an exception handling procedure based on the exception and at least one other criteria, and subsequent to generating the exception handling procedure, receiving a selected reason code inputted by a user, and based on the selected reason code closing the exception alarm or escalating the exception alarm.

2. The method of claim 1, wherein the time interval is between consecutive checkpoints.

3. The method of claim 1, wherein the time interval is between nonconsecutive checkpoints.

4. The method of claim 1, wherein the exception handling procedure is based on at least one other criteria.

5. The method of claim 1, further comprising modifying the predetermined range based on tour data collected from prior tours.

6. The method of claim 1, further comprising modifying the predetermined range based on empirical data.

7. The method of claim 1, wherein the exception handling procedure is negated by one other criteria.

8. A method for processing and resolving exception alarms associated with a guard tour at a premise, comprising:

collecting tour data from a guard device associated with a guard tour at a premise, wherein the tour comprises a plurality of checkpoints;

analyzing the tour data to identify an exception by simultaneously comparing an elapsed time interval between two checkpoints during the guard tour to a first predetermined range and a second predetermined range and determining whether the elapsed time interval is outside at least one of the first predetermined range and the second predetermined range, wherein the second predetermined range is larger than the first predetermined range; and if an exception is identified in the analysis of the tour data, then generating an exception alarm remote from the guard device, the exception alarm subjectable to selective closing and escalating, generating an exception handling procedure based on the exception and at least one other criteria, and subsequent to generating the exception handling procedure, receiving a selected reason code inputted by a user, and based on the selected reason code closing the exception alarm or escalating the exception alarm.

9. The method of claim 8, wherein a first exception based on a first time interval that is outside the first predetermined range but is not outside the second predetermined range generates a different exception handling procedure than a second exception based on a second time interval that is outside the first predetermined range and the second predetermined range.

10. A computer system for processing and resolving exception alarms associated with a guard tour at a premise, comprising:

a collection module that periodically retrieves tour data from a guard device associated with a tour at a premise;

a comparison module that identifies an exception by analyzing the tour data to identify an elapsed time interval between two checkpoints during the guard tour that is outside a predetermined range;

an exception processing module that performs the following steps if an exception is identified in the analysis of the tour data, generating an exception alarm remote from the guard device, the exception alarm subjectable to selective closing and escalating, generating an exception handling procedure based on the exception and at least one other criteria, and subsequent to generating the exception handling procedure, receiving a selected reason code inputted by a user and based on the selected reason code closing the exception alarm or escalating the exception alarm; and an exception reporting module that generates reports based at least in part on the exception.

11. The system of claim 10, wherein the time interval is between consecutive checkpoints.

12. The system of claim 10, wherein the time interval is between nonconsecutive checkpoints.

13. The system of claim 10, wherein the exception handling procedure is based on at least one other criteria.

14. The system of claim 10, wherein the exception processing module modifies the predetermined range based on tour data collected from prior tours.

15. The system of claim 10, wherein the exception processing module modifies the predetermined range based on empirical data.

16. The system of claim 10, further comprising a second predetermined range that is larger than the predetermined range.

17. The system of claim 16, wherein a first time interval that is outside the predetermined range but is not outside the second predetermined range generated a different exception handling procedure than a second time that is outside the predetermined range and the second predetermined range.

18. The system of claim 10, wherein the exception handling procedure is negated by one other criteria.

* * * * *